United States Patent [19]

Bricaud et al.

[11] Patent Number: 5,037,314

[45] Date of Patent: Aug. 6, 1991

[54] CONNECTING ASSEMBLY FOR PRINTED CIRCUIT BOARDS

[75] Inventors: Hervé G. Bricaud; Jean-Francois Lescoat; Jean-Pierre Muot, all of Dole, France

[73] Assignee: ITT Composants et Instruments, Bagneux, France

[21] Appl. No.: 525,371

[22] Filed: May 17, 1990

[30] Foreign Application Priority Data

Jun. 1, 1989 [FR] France ..... 89 07264

[51] Int. Cl.[5] ..... H01R 9/09

[52] U.S. Cl. ..... 439/79; 439/81; 439/78

[58] Field of Search ..... 439/78–82

[56] References Cited

U.S. PATENT DOCUMENTS 4,697,864 10/1987 Hayeo et al. ..... 439/79
4,808,115 2/1989 Norton et al. ..... 439/79
4,836,791 6/1989 Grabbe et al. ..... 439/81
4,871,320 10/1989 Mouissie ..... 439/78
4,923,405 5/1990 Munsterman et al. ..... 439/78

FOREIGN PATENT DOCUMENTS 2550894 8/1983 France .

*Primary Examiner*—Paula A. Bradley
*Attorney, Agent, or Firm*—Thomas L. Peterson

[57] ABSTRACT

A connecting assembly is described for connecting two printed circuit boards (12, 13) comprising a plug (10) and socket (11). The plug has a dielectric peripheral frame (14), at least one plug block (16) in the frame, and contact elements (e.g. 18) in the plug block. The plug frame (14) extends forwardly beyond the front face (27) of the plug block (16) in order to form a receptacle (48R). The socket (11) comprises a peripheral frame (15), at least one socket block (17) mounted in the socket frame, and contact elements (e.g. 19) in the socket block. The socket block (17) extends forwardly (arrow Fs) beyond the front edge (51) of the socket frame (15) and can be received in the plug receptacle (48R).

5 Claims, 9 Drawing Sheets

D $F_P$
$F_S$
$R_S$
55
57
17
31
53
29
13
49
23
39
37
15
11
47
41
43
35
51
48
48R
33
27
16
14
34
42
40
10
38
36
45
21
51
19
25
24
32
26
18
46
44
30
20
28
22
22
50
12
19A
19B
49

CONNECTING ASSEMBLY FOR PRINTED CIRCUIT BOARDS

BACKGROUND OF THE INVENTION

This invention relates to a connecting assembly for connecting two printed circuit boards and particularly for the connecting of a mother board and a daughter board.

A connecting assembly of this type is for example described in the document FR-A-2,550,894. That document describes a plug and socket which are specific to a single application, and which cannot be easily adapted to other layouts or to a different number of, or to a different type of electrical contact element. The density of electrical contacts is particularly low and the insertion force necessary for the connection of the plug in the socket is high.

SUMMARY OF THE INVENTION

In accordance with one embodiment of the present invention, a connecting assembly is provided which facilitates plugging a plug of the assembly into a socket thereof. The plug of the connecting assembly includes a molded insulative frame and at least one insulating block and its contact elements lying within the frame. The plug frame extends beyond the front face of the plug block in order to form a receptacle. The socket includes a molded insulative frame and at least one insulating block and its contact elements lying within the socket frame. The socket block extends towards the plug beyond the front edge of the socket frame so the block can be received in the plug receptacle.

Other characteristics and advantages of the invention will appear on reading the following detailed description and drawings, with the novel features being set forth in the appended claims.

DESCRIPTION OF THE PREFERRED EMBODIMENT

Figures 1, 1A:
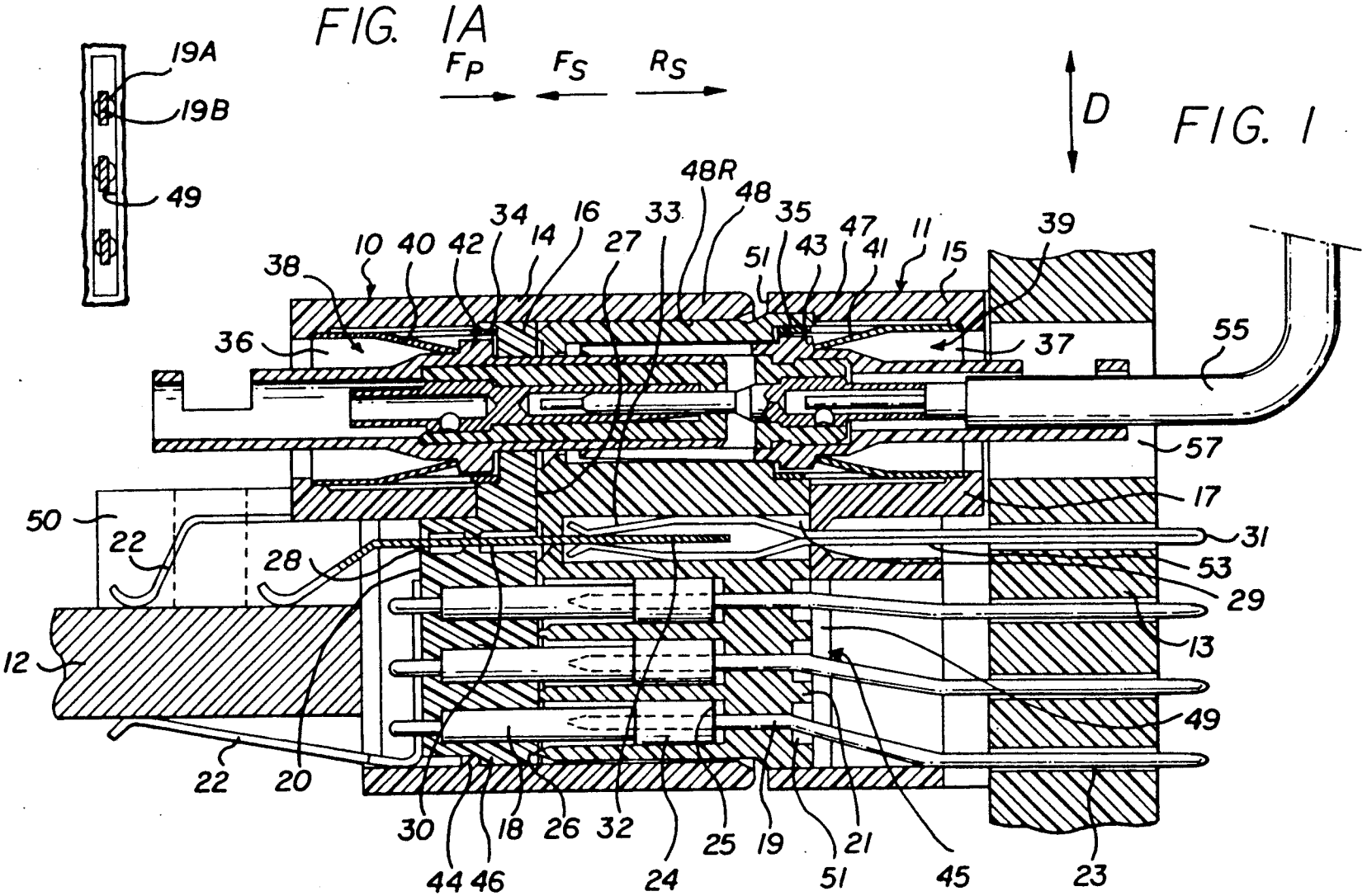
FIG. 1 is a sectional view of a connecting assembly of the invention, taken through a plane perpendicular to the mother and daughter boards, the sectional plane passing through signal contact elements and a pair of coaxial contacts.
FIG. 1A is a partial sectional view of the assembly of FIG. 1, but with flattened signal contact portions.

FIG. shows a connecting assembly comprising a plug 10 and a socket 11 for the electrical connection of electrical tracks respectively formed on a daughter board 12 and a mother board 13. The plug 10 includes a hollow peripheral frame 14 of molded insulative material. The plug has a rectangular cross-section and holds a block 16 of insulating material. The lower section of the plug block 16 shown in FIG. 1 receives, in small-sized holes or cells, female signal contact elements or contacts 18. The combination of the plug block 16 and the contacts such as 18 in the block, form the plug 10. The socket 11 includes a frame 15 of molded insulative material. The plug frame holds a block 17 of insulating material which holds male signal contact elements or contacts 19, the combination forming the socket. The socket contacts 19 have front ends 25 that engage front ends 24 of the plug contacts 18.

The plug 10 has front and rear portions spaced axially along front and rear plug directions indicated by arrows Fp and Rp. The plug 10 moves in the front or forward plug direction Fp to mate with the socket. Similarly, the socket has front and rear portions spaced axially along front and rear socket directions Fs and Rs. The plug block 16 has a front face at 26, while the socket block 17 has a front face at 27. The socket frame 15 has a forward edge at 51.

The electrical contacts 18 of the plug extend axially, in the rearward socket direction Rs, beyond the rear face 20 of the plug block 16. The rear portions of the contacts 18 are connected to conductive traces on the faces of the daughter board 12 by means of bendable connecting beams 22 of the contacts. The beams have ends that are held by spring force against the opposite faces of the daughter board 12 in order to enable connection according to the so-called flat connecting technique. The front ends 24 of the plug contacts 18 protrude axially beyond the front face 26 of the plug block 16 towards the socket 11.

The plug block 16 has a median section above the signal contacts 18, with an open slot 28 which receives a ground connecting strip or conductor 30. The front end 32 of the strip conductor protrudes axially towards the socket 11 beyond the front face 26 of the plug block 16. The plug block 16 has an upper part with a large hole or cell 34 which holds a female coaxial contact 38. The plug frame 14 has a large cell or hole 36 which holds the rear section of the female contact. The female coaxial contact 38 is installed in the plug from the rear and is prevented from movement in the rearward plug direction by a retaining clip 40 having spring fingers which engage a retaining shoulder 42 of the contact.

The axial positions of the plug frame 14 and plug block 16 are defined by an internal shoulder 44 of the plug frame which abuts an external shoulder 46 of the plug block. The plug frame 14 has a forward side wall 48 that extends forwardly beyond the front face 26 of the plug block 16. The forwardly projecting frame side walls form a receptacle 48R for receiving a section of complementary shape of the socket block 17.

The male socket contact elements or contacts 19 extend rearwardly beyond the rear face 21 of the socket block 17 and through a hole in the socket frame 15 in order to enter corresponding holes 23 in the mother board 13. The front face 27 of the socket block 17 is in contact with the front face 26 of the plug block 16. The front ends 24 of the female or plug contacts 18 enter cells or holes in the socket block 17. These cells are formed around the front free ends 25 of the socket contacts 19.

The socket block 17 has a slot 29 which holds a grounded strip-like conductor 31 whose front end, in the shape of a clip 33, receives the front end 32 of the grounded strip-shaped conductor 30 of the plug 10. Upper portions of the socket block 17 and of the socket frame 15 have large-sized cells or holes 35 and 37 which hold the rear section of a male coaxial contact 39. The male coaxial contact 39 mates with the female coaxial contact 38 in the plug. The male coaxial contact 39 is prevented from rearward movement by an external clip with spring fingers 41 which engage the rear face of a shoulder 43 of the body of the male or socket coaxial contact 39.

The socket frame 15 has a front edge 51 and has a front face 47 that lies behind the frame front edge. The rear face 21 of the socket block 17 bears against the frame front face 47. The front of the socket frame near its front edge 51 surrounds the rear portion of the socket block. A front portion of the socket frame 15 has elongated slots or slits 49. The rear ends of the male electrical signal contacts 19 pass through the slits and through the mother board 13. The slits are oriented to enable a displacement of the connecting assembly including the contacts 19 with respect to the mother board, in the directions D parallel to the plane of the mother board.

As mentioned above, when the plug and socket are mated, the socket block 17 extends forward of the front edge 51 of the molded insulative socket frame 15 and is received in the receptacle 48R formed within the front wall 48 of the plug frame 14. This arrangement eliminates the conventional use of metal shells on the plug and socket which interfit during mating. In this way, the additional thickness required for such metal shells and their mounting are avoided, which enables an increase in the number of contacts for a given external frame size. Guidance during mating is provided between the socket block 17 and the front wall 48 of the plug frame. The frames 14, 15, like the insulating blocks are preferably plastic molded parts, instead of metallic shells, and limit relative sideward movement of the mated plug and socket.

Initial contact between the plug and socket is made between the protruding front portion of the socket block 17 and the receptacle portion of the plug frame 14. It is desirable to provide locating means for locating the socket block and plug frame, which will be described below with reference to FIGS. 11 to 15.

Figure 2:
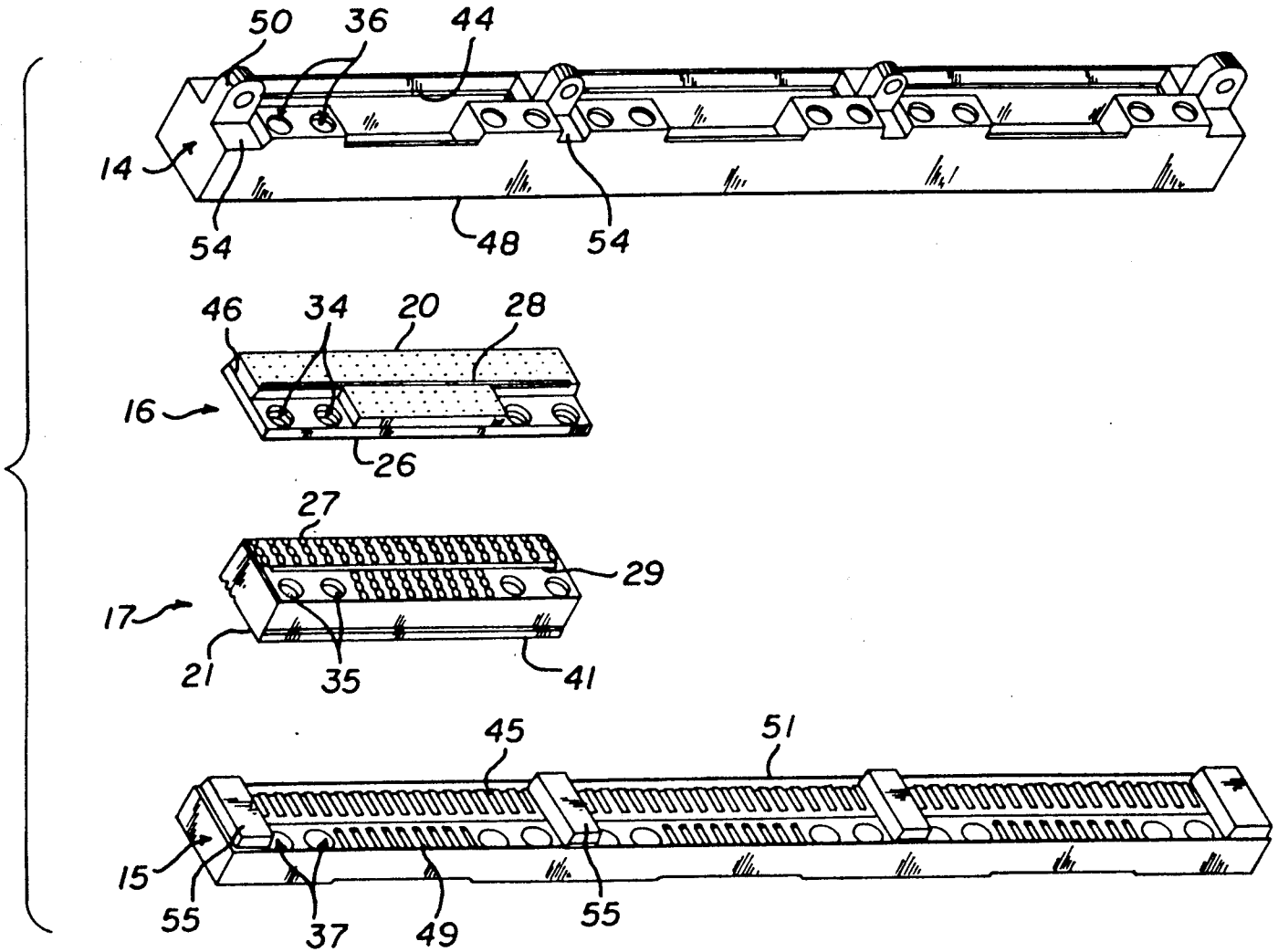
FIG. 2 is a partial exploded perspective view of the assembly of FIG. 1, but without the electrical contact elements.
Figure 5:
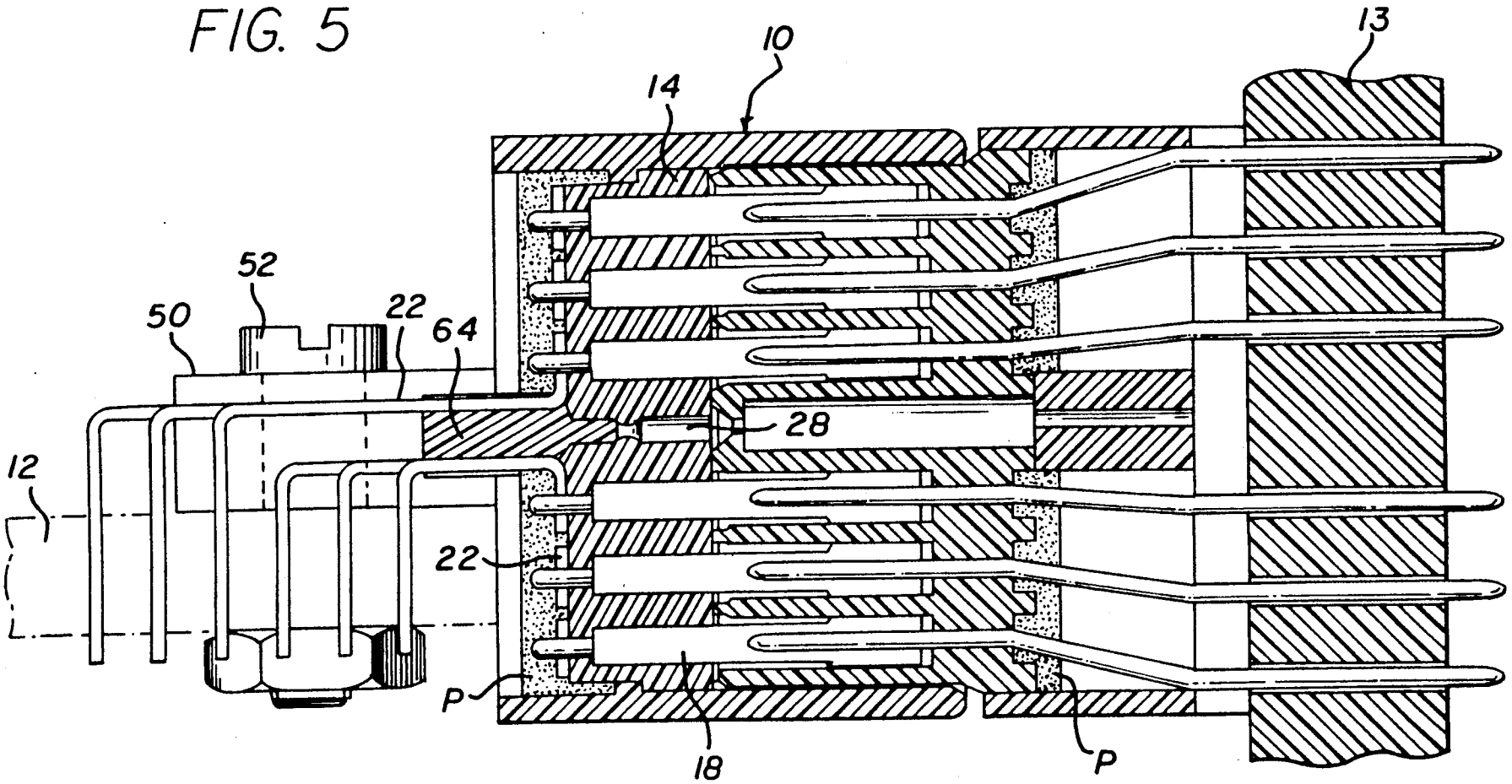
FIG. 5 is a view similar to that of FIG. 1 in which the connection of the electrical contacts of the plug is performed by projecting them into the daughter board instead of engaging pads on the daughter board surface as in FIG. 1, the assembly not having ground connection strips.

As shown in FIG. 2, the plug frame 14 has lugs 50 for fixing the plug to the daughter board 12 (by means of screws shown in FIG. 5 at 52). The plug and socket frames 14, 15 are each constructed to hold three connecting blocks 16, 17 placed in tandem along their lengths in the frames. The frames have areas 54 and 55 where the frames are fixed to their respective boards, and have locating, locking and closing means which are not shown.

Figure 3:
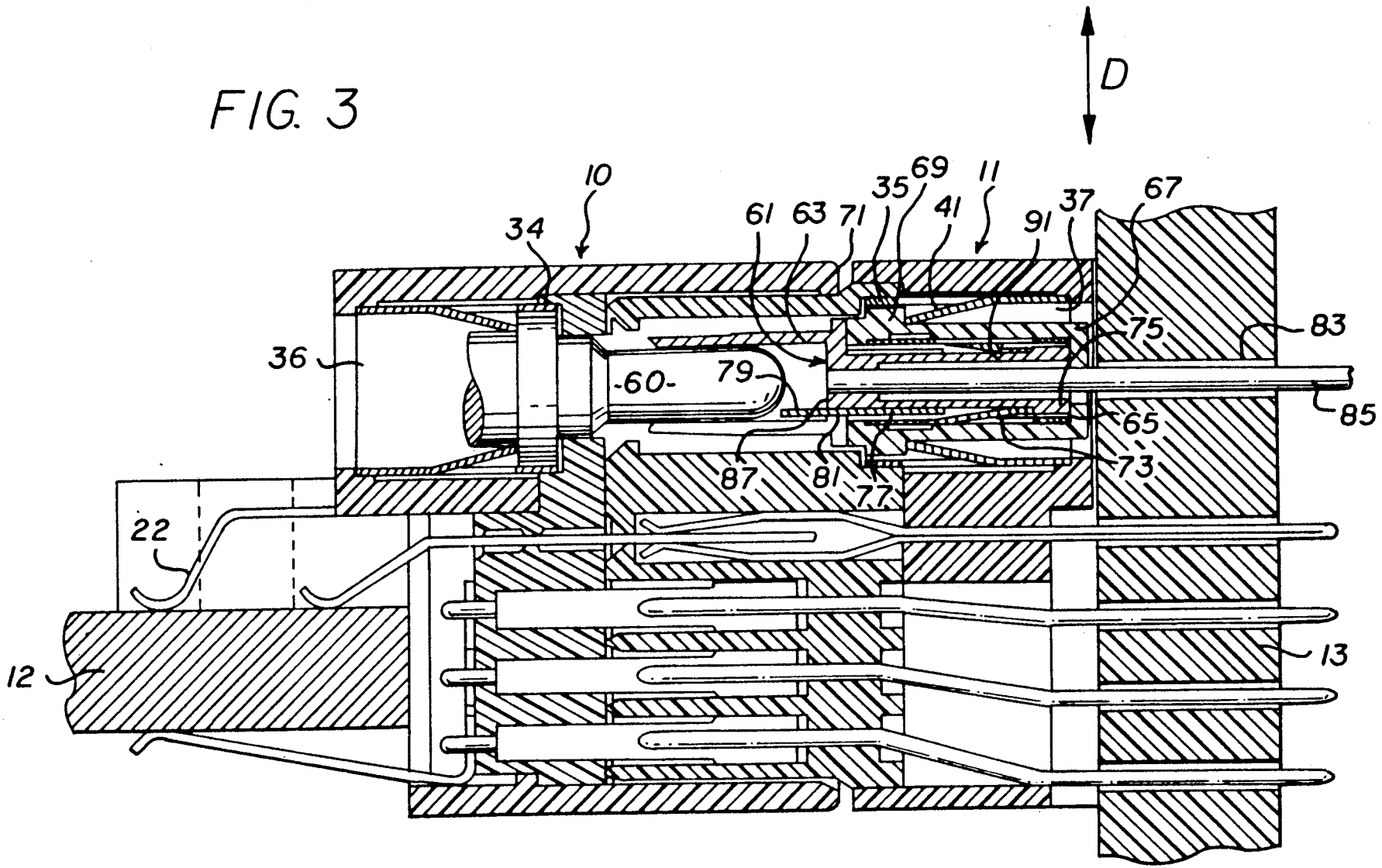
FIG. 3 is a view similar to that of FIG. 1 in which the plane of cross-section passes through a pair of power contacts.

Each block 16, 17 in FIG. 2 has eighty-four holes or cells for receiving signal contacts 18, 19 and four larger holes such as 34 (in block 16) and 35 (in block 17) which can receive either a coaxial contact as at 39 in FIG. 1, or a power contact as at 60 in FIG. 3. The larger holes can instead hold a cooling fluid contact, which is not shown in the fixtures, which enables the circulation of a heat conducting liquid. If it is desired to further increase the connection density of the block, it is possible to provide, for example, three small contact-holding holes between the large-sized pairs of cells such as 34. It is possible to produce connecting assemblies of smaller size using the same connection modules by limiting the length of the frame to a single housing, such as the left hand third of the frames 14 and 15 shown in FIG. 2.

The connecting apparatus is constructed by assembling the signal contacts (e.g. 18, 19 in FIG. 1) and the ground contacts (30, 33) in their respective insulating blocks. The male or female coaxial contacts are fitted from the rear into their corresponding cells or holes. The final connection between the plug and socket blocks 16 and 17 and the frames 14 and 15 is carried out by placing adhesive on areas of the block rear faces 20 and 21 as indicated by the letter P in FIGS. 4, 5 and 6. The socket block 17 has small openings 51 (FIG. 1) which surround the rear sections of the electrical contacts 19 and which can be filled with adhesive to immobilize the contacts before the insertion of the socket into the frame. The blocks are inserted into the corresponding frames until they engage shoulders 42, 43.

According to the invention, provision is made to allow displacement in the direction D of the socket 11 with respect to the mother board 13. Such displacement is especially useful when the socket 11 and plug 10 and daughter board 12 are held against a heat absorption or cooling device that is sometimes called a "thermal board-guide connector". As mentioned, the rear sections of the male socket contacts 19 are received in slots of the socket frame 15 in which they can move by deflection. For this purpose the rear portions of the signal contacts which extend through the slots 49 are advantageously flattened portions of originally cylindrical contact elements, whose flattened faces are perpendicular to the direction of displacement D. FIG. 1A shows contacts 19A with flattened portions 19B extending through a slot 49 of the socket frame 15. An opening 53 (FIG. 1) is also formed around the ground strip 31 in order to allow for its transverse displacement. The distance between the rear of the socket block 19 in which the socket contacts are fixed, and the mother board 13 in which the contacts are also fixed, enables bending of the portions of the contacts 19 lying in the slots 49 in the rear portion of the socket frame.

The rear section of the coaxial cable 55 and of the external body of the coaxial contact 39 can move in a large-sized orifice of the board 13. By means of these characteristics it is possible to slightly displace the plug and socket in the direction D without damaging any of the components of the connecting assembly. The various cells, orifices and slots formed in the insulating blocks and in the plug and socket frames are aligned with locating means (not shown) provided for the relative positioning of the blocks in the frames.

The large-sized cylindrical cells also enable the mounting of power contacts such as those shown at 60 and 61 in FIG. 3. The male power contact 60 is mounted in cells 34, 36 of the plug block and frame in the same way as the male coaxial contact 38 in FIG. 1. The connection of the male power contact rear section, which is not shown, can be carried out by means of a flexible cable or by a bent end enabling its flat connection in the same way as the beams 22. The female power contact 61 has a structure enabling its fitting from the rear and its partial removal for repair from the front as well as transverse displacement in the direction D. The female contact body 63 has a rearwardly extending cylindrical sleeve 65 which is disposed in an intermediate shouldered bushing 67 which is itself received in the socket block and frame cells 35 and 37.

The axial positioning and the maintaining of the intermediate bushing 67 in the cells is conventional and identical to that of the female coaxial contact body 37, i.e. by means of a clip with internal spring fingers 41 whose ends engage a shoulder 69 which itself bears against a facing shoulder 71 of the insulating block. The internal cylindrical sleeve is positioned and maintained in the intermediate bushing 67 by means of an internal holding clip 73 having a structure similar to that of the external clip 41. Its arrangement is axially reversed such that the free ends of the fingers which are radially bent towards the interior, are in contact with an opposite face 75 of the rear shoulder of the internal sleeve 65.

A split ring 77 is mounted between the internal stepped sleeve 65 of the female contact body and the internal clip 73. The split ring has a forwardly protruding end 79 that can be pushed rearwardly to allow the contact body to be removed from the front of the contact body 61 and of the sleeve 65. The end 79 can be omitted and replaced by a tool, which is not shown, which is inserted inside the female power contact through the slot 81 provided for the end 79, the ring 77 being a split ring permanently mounted in the contact.

The female power contact 61 is initially installed from the rear of the socket frame 15 into the cells 35 and 37. The power contact will have already been positioned in the intermediate bushing 67. A high-conductivity copper conductor 85 has been inserted inside the stepped sleeve 65 until its free end 87 can be brazed from the front to join it to the contact body 61 before mounting in the cells. If it is desired to make a repair it is possible to extract the female contact from the front by expanding the internal holding clip 73, the intermediate bushing 67 remaining in place in the socket 11, all of these operations being carried out after having unsoldered the conductor 85.

The axial displacement D is made possible by means of the small cross-section of the conductor 85 which is received with radial play in the much larger internal bore 91 of the sleeve 65. If it is not necessary to provide for the possibility of transverse displacement D, the internal sleeve 65 and the conductor 85 can form a single element of larger diameter without radial displacement play.

It will be noted that the female power contact shown in FIG. 3 retains the conventional function of repair by extraction from the rear by expanding the clip 41. This enables the extraction of the contact assembly, including the intermediate bushing 67, by means of a conventional ring shaped tool inserted in the radial clearance provided for this purpose. The combination of two removable internal and external clips enable the mounting of the power contact from the rear and its partial repair by extraction from the front without having to remove the socket assembly 11 from the board 13. The variant of the connecting assembly shown in FIG. 4 enables the connection of two parallel mother boards 12 and 13. The rear ends of the electrical signal contacts, the coaxial contacts and the power contacts are similar, the other components of the plug 10 and of the socket 11 being similar to those of the embodiment shown in the previous figures.

The connecting assembly shown in FIG. 5 differs from that shown in FIG. 1 in that it does not include any ground connecting strips. Also, in that the connecting parts 22A of the rear ends of the female contacts 18 of the plug 10 are connected to the board 12 by projecting into the board. A ground strip could nevertheless be provided and molded as in the previous examples. As there is not ground strip, a plug 64 can be molded in the insulating block 14 in order to close the slit 28 towards the rear.

Figure 6:
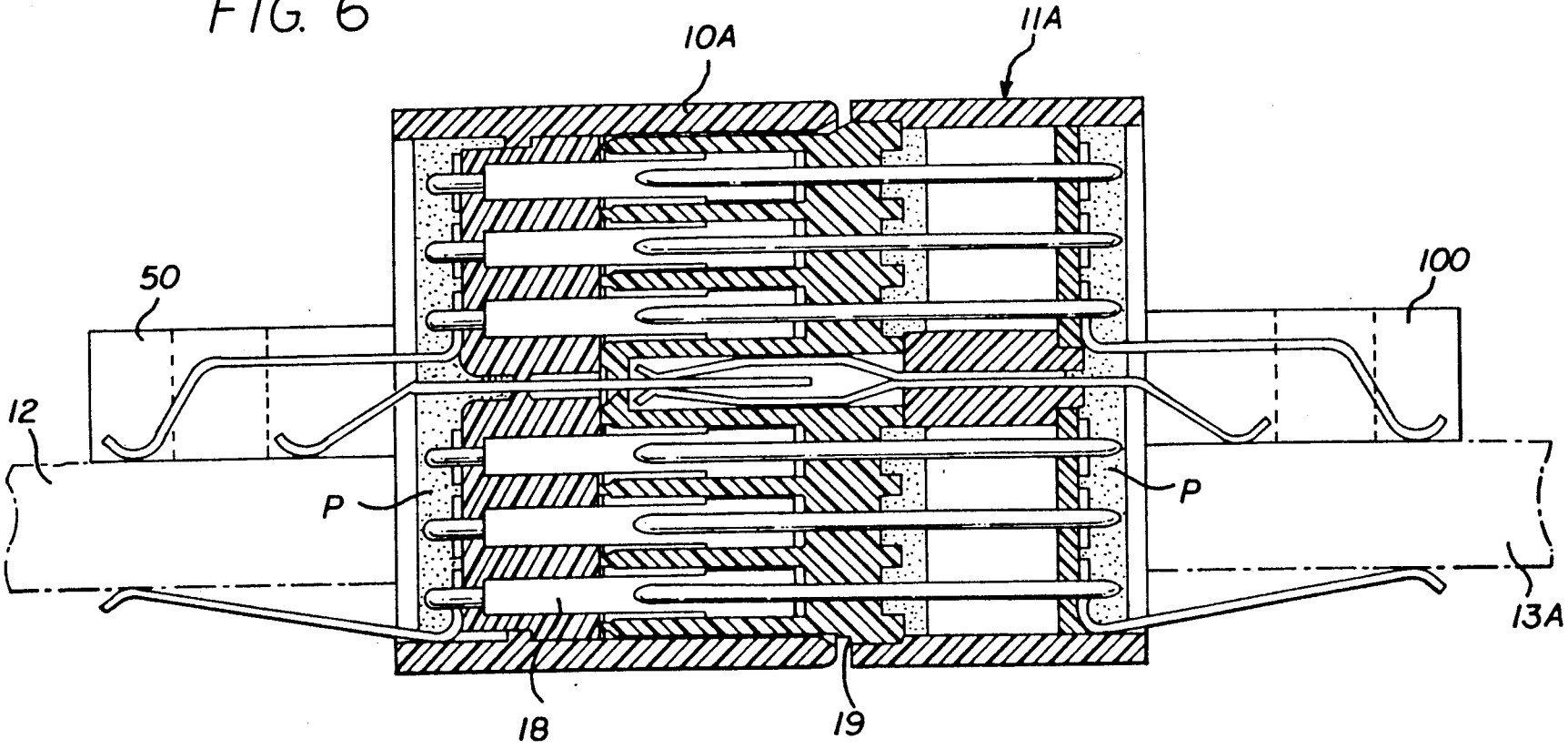
FIG. 6 is a view similar to that of FIG. 1 in which the socket is of the so-called extender type to enable the electrical connection of two daughter boards, the plane of cross-section passing through six electrical signal contacts.
Figure 8:
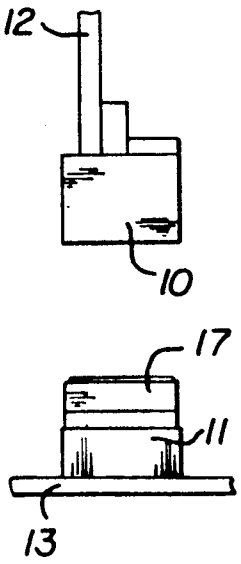
FIG. 8 is a left side view of the apparatus shown in FIG. 7.
Figure 7:
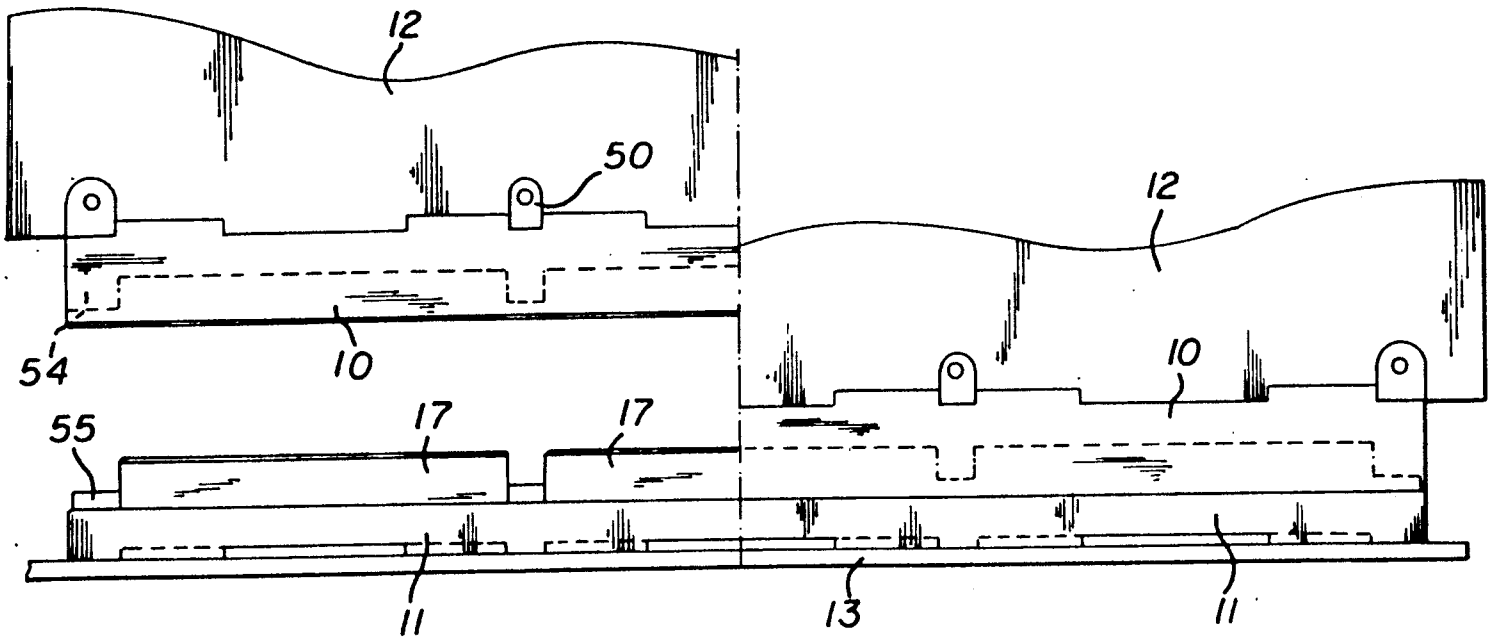
FIG. 7 is a simplified view of the connecting assembly shown in FIGS. 1 and 2, the left-hand half-view being shown in a disconnected configuration while the right-hand half-view is shown in a connected configuration.
Figure 10:
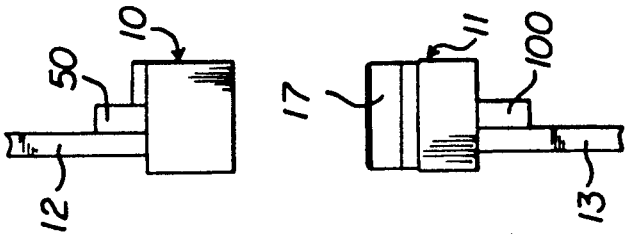
FIG. 10 is a left side view of the assembly of FIG. 9.
Figure 9:
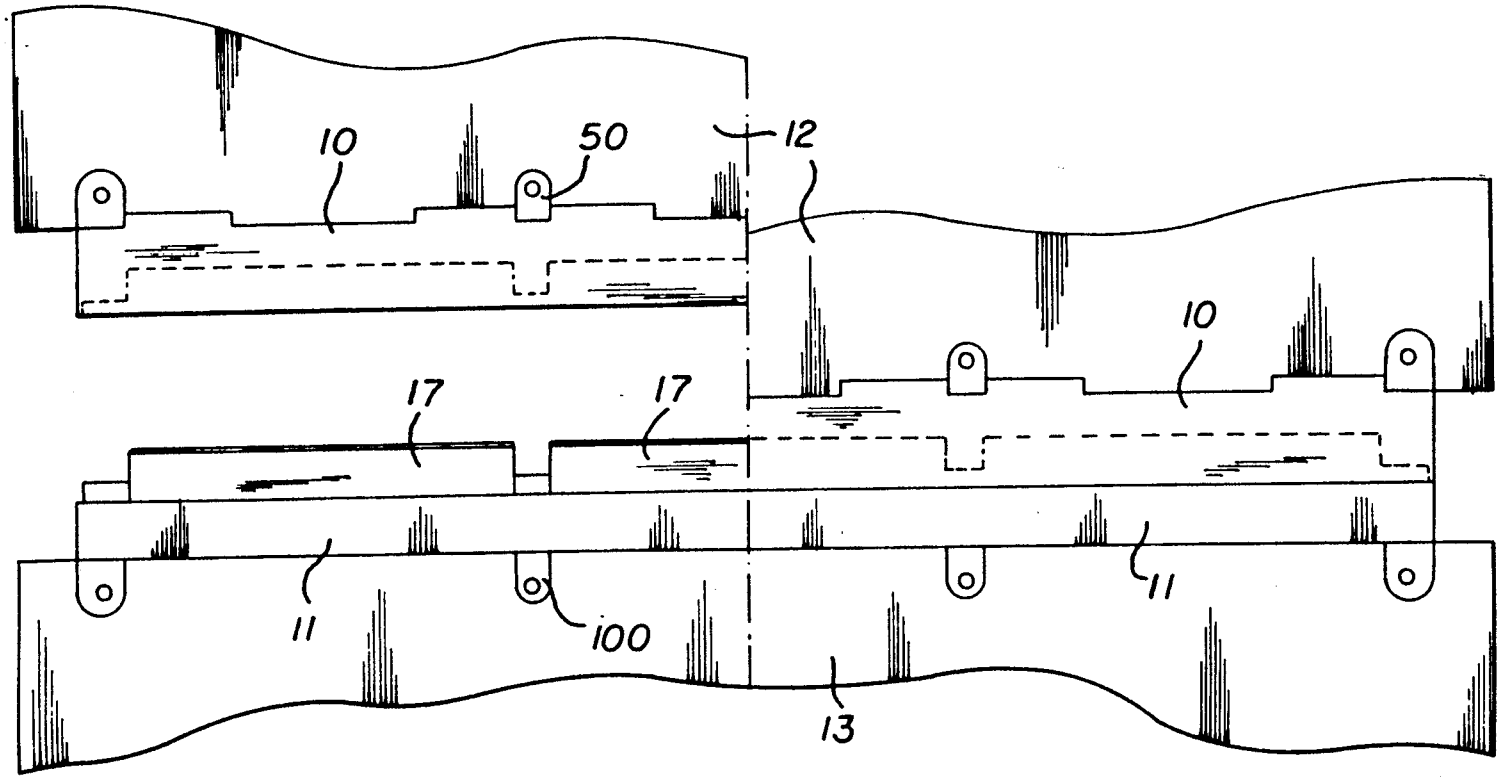
FIG. 9 is a simplified view of the plug and extender socket connecting assembly of FIG. 6, the left hand half-view showing the assembly in a disconnected configuration and the right-hand half-view showing it in a connected configuration.

In the connecting module shown in FIG. 6, the socket 11A is modified in its rear section in order to enable the connection of a daughter board 12A to an extending daughter board 13A in alignment with the other board, i.e. in order to constitute an assembly called an extender. The rear section of the extender socket 11A is similar to that of the plug 10A and to the plug shown in FIGS. 1 and 2 and includes fixing lugs 100 for fixing onto the second mother board 13A. A socket forming an extender is shown in FIGS. 9 and 10.

Figure 4:
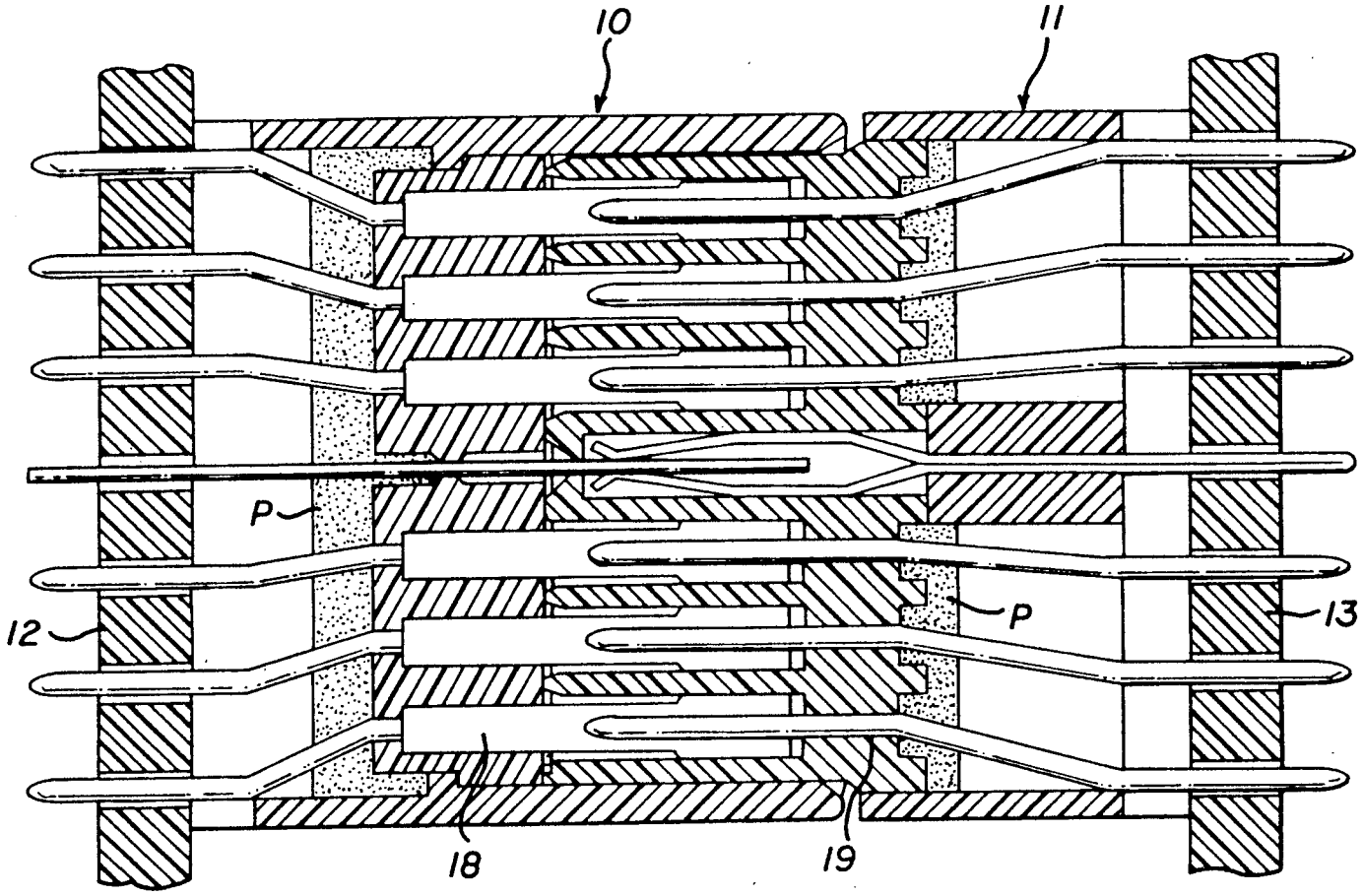
FIG. 4 is a view largely similar to that of FIG. 1, but for the connection of two parallel daughter boards, the plane of cross-section passing through six electrical signal contacts.

In the above descriptions all of the signal contacts of the plugs 10, 10A are female contacts while the contact elements of the sockets 11, 11A are male contacts. It is noted that by combining an extender socket 11A such as shown in FIG. 6 with a plug enabling projecting such as shown in FIG. 4, it is possible to reverse the direction of connection, i.e. to fit the mother board with female contacts and the daughter board with male contacts. The above shows a range of connecting assemblies enabling connections of a variety of printed circuit boards.

Figure 12:
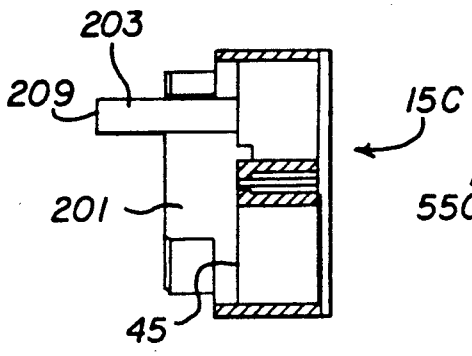
FIG. 12 is a cross-sectional view taken on line 12—12 of FIG. 11.
Figure 11:
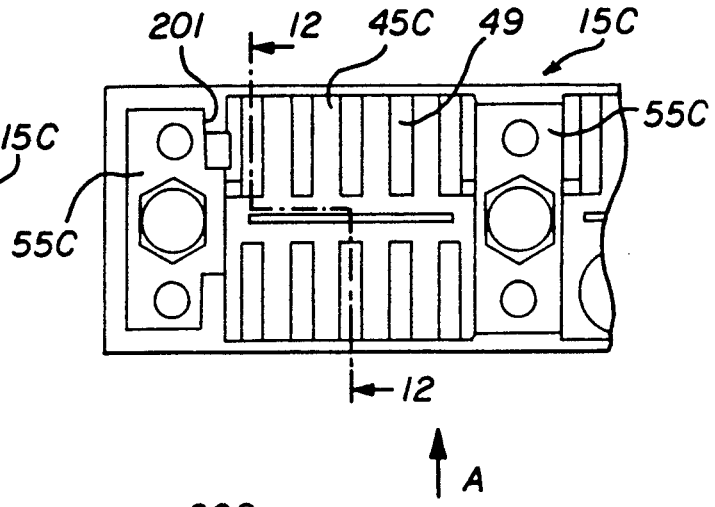
FIG. 11 is a front view of a portion of a socket frame of FIG. 10 including locating means.
Figure 13:
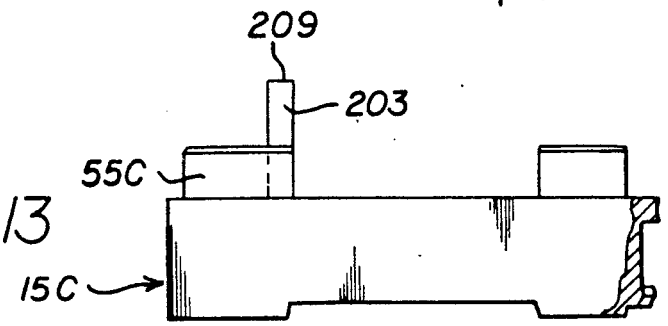
FIG. 13 is a view in the direction of the arrow A in FIG. 11.
Figure 14:
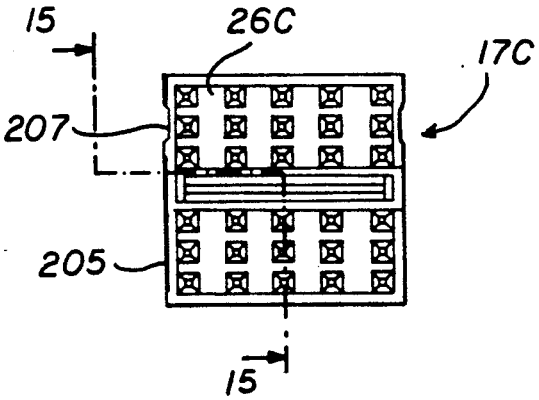
FIG. 14 is a view of an insulating block which is complementary to the frame of FIG. 11.
Figure 15:
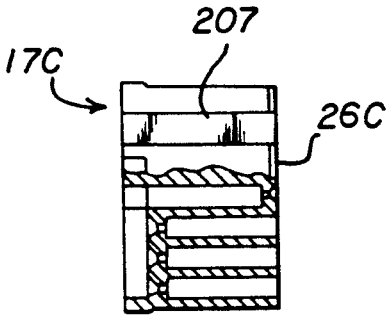
FIG. 15 is a cross-sectional view taken on line 15—15 of FIG. 14.

FIGS. 11–13 show a lateral end of a socket frame 15C which can hold a socket block 17C shown in FIGS. 14 and 15. The end area 55C of the frame has a rectangular shape. The end area 55C has a lateral face 201 facing the block 17C, which includes a locating pin 203. The pin extends from the front face of a partition 45C and protrudes beyond the face of the end area 55C.

The block 17C has a lateral face 205 which faces towards the frame 201. The block face 205 has an axial groove 207 which receives the pin 203. The pin 203 extends axially beyond the front face 26C of the block 17C in the direction of the plug in order to be received in a locating hole having a corresponding cross-section formed in the corresponding hole in the plug frame (not shown). An identical locating pin is placed symmetrically at the other end of the socket frame 15C together with a corresponding hole in the plug frame. The pins and holes are offset from the median plane of the frames in order to prevent incorrect assembly. It is not necessary to provide any lateral groove in the plug insulating block since its front face is set back from the free end 209 of the pin 203.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. In a connecting assembly for connecting first and second printed circuit boards (12, 13) which include a plug (10) mounted to said first (12) of said boards, said plug including an insulating plug block (16) with front and rear faces (26, 20) and plug electrical contacts (18) in said plug block, said plug contacts having front ends (24) extending forwardly beyond said plug block front face and having rear ends extending rearwardly beyond said plug block rear face in order to be connected to the said first board, said connecting assembly also including a socket (11) mounted to said second of said boards, said socket including an insulating socket block (17) with first and rear faces (27, 21) and socket electrical contacts (19) in said socket block mateable with corresponding of said plug contacts, said socket contacts having front ends (25) and said socket contacts having rear ends extending rearwardly beyond said block rear face (21) in order to be connected to the said second board, the improvement wherein:

said plug (10) includes an insulative plug frame (14) which receives said plug block (16) and its contacts, said plug frame (14) extending in a predetermined plug front direction (Fp) beyond the said plug block front face (26) and forming a receptacle (48R) forward of said plug block front face;

said socket (11) includes an insulative socket frame (15) which has a front frame edge (51), said socket frame receives said socket block (17) and its contacts, said socket block (17) extending in a predetermined socket front direction (Fs) which is opposite to said plug front direction, beyond said front edge (51) of socket frame (15) in order to be received in the said receptacle.

2. The improvement described in claim 1 wherein:

said plug frame has an internal shoulder (44) and said plug block has an external shoulder (46) that substantially abuts said plug frame internal shoulder;

said socket frame has an internal shoulder forming a front face (47) and said socket block has an external shoulder forming a rear face (21) that substantially abuts said socket frame front face.

3. The improvement described in claim 1 including:

a quantity of adhesive (P) disposed between the rear face of each block (16, 17) and a corresponding frame (14, 15).

4. The improvement described in claim 1 wherein:

said socket block has holes that closely surround said socket contact elements, and said socket frame has a portion that lies rearward of said socket block and that has slots (49) that receive portions of said socket contact elements that extend between said socket block and said second board (13), said slots in said socket frame portion being elongated in a direction (D) perpendicular to said socket front direction, whereby to provide space for bending of said socket contact elements.

5. The improvement described in claim 4 wherein:

a plurality of said socket contact elements have portions in said socket block which are of cylindrical cross-section, and have portions (19B) in said socket frame slots (49) which are flattened to have a reduced cross-section as seen along said slot elongated direction (D).

* * * * *